252-99 AU 166 EX
12/18/79 OR 4,179,391

United States Patent [19]

Kaufmann et al.

[11] 4,179,391

[45] Dec. 18, 1979

[54] PHOSPHATE-FREE TEXTILE DETERGENT, ESPECIALLY FOR WASHING AT TEMPERATURES OF OVER 75° C.

[75] Inventors: Jochen Kaufmann, Düsseldorf; Markus Berg, Düsseldorf-Holthausen; Peter Krings, Krefeld, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 896,691

[22] Filed: Apr. 17, 1978

[30] Foreign Application Priority Data

Apr. 22, 1977 [AT] Austria ..... 2839/77

[51] Int. Cl.[2] ..... C11D 3/12; C11D 3/36; C11D 3/39; C11D 3/60

[52] U.S. Cl. ..... 252/99; 8/111; 8/137; 252/89.1; 252/98; 252/174.22; 252/102; 252/113; 252/174.25; 252/116; 252/131; 252/140; 252/179; 252/526; 252/545; 252/DIG. 11; 252/DIG. 17

[58] Field of Search ..... 8/111, 137; 252/89, 252/98, 99, 102, 131, 140, 179, 526, 545, DIG. 11, DIG. 17

[56] References Cited

U.S. PATENT DOCUMENTS

| | | | |
|---|---|---|---|
| 3,122,417 | 2/1964 | Blaser | 252/99 X |
| 3,234,140 | 2/1966 | Irani | 252/99 X |
| 3,766,078 | 10/1973 | Kolwalski | 252/99 X |
| 3,795,625 | 3/1974 | Kolwalski | 252/99 X |
| 3,954,643 | 5/1976 | Krings | 252/96 |
| 3,959,168 | 5/1976 | Germscheid | 252/180 |
| 4,055,505 | 10/1977 | Gray | 252/102 |
| 4,064,062 | 12/1977 | Yurko | 252/99 |
| 4,072,622 | 2/1978 | Kuhling | 252/179 |
| 4,083,793 | 4/1978 | Jakobi | 252/99 |

*Primary Examiner*—Dennis L. Albrecht
*Attorney, Agent, or Firm*—Hammond & Littell

[57] ABSTRACT

A pulverulent, phosphate-free textile detergent consisting essentially of:

(a) from 20% to 40% by weight of a water-insoluble, finely-divided, crystalline alkali metal aluminosilicate having a calcium binding power of 50 to 200 mg of CaO/gm on the anhydrous basis;

(b) from 5% to 20% of a surface-active compound of the anionic, nonionic, amphoteric or zwitterionic types;

(c) from 0.05% to 0.75% by weight of a water-soluble substituted alkane diphosphonate or triphosphonic acid or alkali metal salts thereof;

(d) from 10% to 35% by weight of an inorganic per compound; and (e) from 0 to 50% by weight of other conventional ingredients for detergents of the type; wash alkalis, soil suspension agents, optical brighteners, enzymes, antimicrobial agents, textile softeners, coloring compounds, perfumes, sodium sulfate and water.

32 Claims, No Drawings

PHOSPHATE-FREE TEXTILE DETERGENT, ESPECIALLY FOR WASHING AT TEMPERATURES OF OVER 75° C.

BACKGROUND OF THE INVENTION

Detergents which contain a finely divided, water-insoluble, cation exchanging alkali metal aluminosilicate as substitute for phosphate have been described in German Published Application (DOS) No. 2,412,837, as well as U.S. Patent Application Ser. No. 458,306, filed Apr. 5, 1974, and now abandoned in favor of continuation application Ser. No. 800,308, filed May 25, 1977, now abandoned in favor of continuation-in-part application Ser. No. 956,851, filed Nov. 2, 1978. The cation exchanging properties of these aluminosilicates manifest themselves in their calcium binding capacity which amounts to at least 50 mg of CaO per gm of anhydrous substance, when tested at about 20° C., and more particularly, within the range of from 100 to 200 mg of CaO/gm. It is preferred to use synthetically produced crystalline aluminosilicates containing bound water which have the composition, $0.7\text{–}1.5Me_2O.Al_2O_3.1.3\text{–}4\text{-}SiO_2$, and in particular those having the composition, $0.7\text{–}1.1Me_2O.Al_2O_3.1.3\text{–}3.3SiO_2$, based in each case on their anhydrous form, Me representing an alkali metal such as sodium or potassium. The sodium aluminosilicates are generally preferred in practice.

According to the teaching in the aforesaid German Offenlegungsschrift No. 2,412,837, the cation exchanging aluminosilicates are advantageously used in combination with water-soluble complex formers for the purpose of improving and speeding up the washing process.

In German Published Application (DOS) No. 2,540,510, as well as in U.S. patent application Ser. No. 505,626, filed Sept. 13, 1974, there is described a detergent for cold washing and washing at 60° C. which, in addition to containing from 5% to 20% by weight of the cation exchanging aluminosilicate defined above, contains mainly a surface-active component of paraffin sulfonate and olefin sulfonate and up to 30% by weight of sodium silicate and preferably does not contain any soluble complex formers, particularly no detergent phosphates. This detergent, however, is unsatisfactory in its primary and secondary washing power at all temperatures. The properties of this detergent cannot be substantially improved by the addition of a compound containing active oxygen or by employing it under the conditions of a boiling wash procedure.

Another phosphate-free textile detergent based on the aluminosilicates defined above, so-called wash alkalis, in particular alkali metal silicates and carbonates, certain organic complex forming salts from the group of alkali metal salts of phosphorus-free polymeric polycarboxylic acids and the phosphonic acids, and a surface-active component consisting of nonionic surface-active agents and optionally anionic surface-active agents has already been proposed. This detergent contains from 0.1 to 2 parts by weight of the organic complex former to 1 part by weight of the water-insoluble aluminosilicate, based on the anhydrous compounds.

OBJECTS OF THE INVENTION

An object of the present invention is the development of a pulverulent bleaching textile detergent for use at high temperatures, in particular for the boiling wash procedure, which, in addition to the bleaching component, contains mainly surface-active agents, water-insoluble, cation exchanging alkali metal aluminosilicates and a small quantity of certain critical water-soluble organic complex formers.

Another object of the present invention is the further development of the substitution of cation exchanging aluminosilicates for phosphates in detergents.

Another object of this invention is that the quantity of water-soluble complex formers, whose presence in detergents containing aluminosilicates is important for good washing results, should be reduced to such a level that it causes no pollution of the effluent. It is also a particular aim of the invention to develop a detergent which, while being completely free from sodium tripolyphosphate and containing a minimum quantity of soluble complex formers, has an efficient primary and secondary washing action and is not harsh on fabrics even in a boiling wash in spite of the high content of per compounds which is necessary for an efficient bleaching action.

A further object of the present invention is the development of a pulverulent, phosphate-free textile detergent consisting essentially of:

(a) from 20% to 40% by weight of a water-insoluble, finely-divided, synthetically-produced, crystalline alkali metal aluminosilicate containing at least some combined water and having primary particles in the size range of from 100μ to 0.01μ and a calcium binding power of from 50 to 200 mg CaO/gm of anhydrous active substance when measured at 22° C. by the Calcium Binding Power Test Method described in the specification and the formula on the anhydrous basis $0.7\text{–}1.5Me_2O.Al_2O_3.1.3\text{–}4.0SiO_2$ where Me is an alkali metal;

(b) from 5% to 20% by weight of a surface-active component selected from the group consisting of at least one of anionic surface-active compounds, nonionic surface-active compounds, amphoteric surface-active compounds and zwitterionic surface-active compounds, optionally with up to 50% of the surface-active component replaced by foam inhibitors;

(c) from 0.05% to 0.75% by weight of a water-soluble organic complex former selected from the group consisting of (i) diphosphonates having the formula

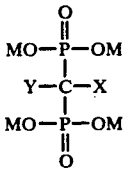

wherein X is a member selected from the group consisting of hydroxy and amino, Y is a member selected from the group consisting of alkane having from 1 to 5 carbon atoms, aminoalkane having from 2 to 5 carbon atoms, hydroxyalkane having from 2 to 5 carbon atoms, phenyl, hydroxyphenyl, aminophenyl and halophenyl and M is a member selected from the group consisting of hydrogen and alkali metal, and (ii) aminotri(lower alkylene phosphonic acid) and its alkali metal salts;

(d) from 10% to 35% by weight of an inorganic per compound releasing hydrogen peroxide in water; and (e) from 0 to 50% by weight of other conventional ingredients for detergents of the type: wash alkalis, soil suspension agents, optical brighteners, enzymes, antimicrobial agents, textile softeners, coloring compounds, perfumes, sodium sulfate and water.

A yet further object of the invention is the process of washing textiles in aqueous solution at temperatures above 75° C. employing the above pulverulent, phosphate-free textile detergent.

These and other objects of the present invention will become more apparent as the description thereof proceeds.

DESCRIPTION OF THE INVENTION

The above objects have been achieved by the development of a phosphate-free detergent or washing composition based on cation exchanging alkali metal aluminosilicate when care is taken that in addition to a selected tenside component certain critical complex forming, water-soluble, organic substituted phosphonates are present in amounts of below 1% by weight based on the total weight.

The invention therefore provides a detergent which contains:

(a) from 20% to 40% by weight of a water-insoluble, finely-divided, synthetically-produced, crystalline alkali metal aluminosilicate which contains bound water and corresponds to the formula, $0.7\text{–}1.5Me_2O.Al_2O_3.1.3\text{–}4.0SiO_2$ (based on the anhydrous active substance = AS), in which Me represents sodium or potassium, which alkali metal aluminosilicate has a calcium binding capacity of from 50 to 200, preferably from 100 to 200 mg of CaO/gm of AS;

(b) from 5% to 20% by weight of a surface-active component consisting of at least one anionic, nonionic, amphoteric or zwitterionic surface-active agent and optionally foam inhibiting additives;

(c) from 0.5 to 0.75% by weight, preferably 0.2 to 0.6% by weight, of a water-soluble organic complex former which is a substituted alkane di- or triphosphonic acid or an alkali metal salt thereof; and (d) from 10% to 35% by weight of an inorganic per compound.

More particularly, the present invention relates to a pulverulent, phosphate-free textile detergent consisting essentially of:

(a) from 20% to 40% by weight of a water-insoluble, finely-divided, synthetically-produced, crystalline alkali metal aluminosilicate containing at least some combined water and having primary particles in the size range of from 100μ to 0.01μ and a calcium binding power of from 50 to 200 mg CaO/gm of anhydrous active substance when measured at 22° C. by the Calcium Binding Power Test Method described in the specification and the formula on the anhydrous basis $0.7\text{–}1.5Me_2O.Al_2O_3.1.3\text{–}4.0SiO_2$ where Me is an alkali metal;

(b) from 5% to 20% by weight of a surface-active component selected from the group consisting of at least one of anionic surface-active compounds, nonionic surface-active compounds, amphoteric surface-active compounds and zwitterionic surface-active compounds, optionally with up to 50% of the surface-active component replaced by foam inhibitors;

(c) from 0.05% to 0.75% by weight of a water-soluble organic complex former selected from the group consisting of (i) diphosphonates having the formula

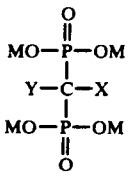

wherein X is a member selected from the group consisting of hydroxy and amino, Y is a member selected from the group consisting of alkane having from 1 to 5 carbon atoms, aminoalkane having from 2 to 5 carbon atoms, hydroxyalkane having from 2 to 5 carbon atoms, phenyl, hydroxyphenyl, aminophenyl and halophenyl and M is a member selected from the group consisting of hydrogen and alkali metal, and (ii) amino tri(lower alkylene phosphonic acid) and its alkali metal salts;

(d) from 10% to 35% by weight of an inorganic per compound releasing hydrogen peroxide in water; and (e) from 0 to 50% by weight of other conventional ingredients for detergents of the type: wash alkalis, soil suspension agents, optical brighteners, enzymes, antimicrobial agents, textile softeners, coloring compounds, perfumes, sodium sulfate and water.

When fabrics were washed with the detergent according to the invention under boiling wash conditions (98° C.), it was surprisingly found that the properties of protecting the fabric were even more pronounced in the detergent according to the invention than in the conventional high quality detergents which have a high phosphate content. This finding is completely unexpected since it has hitherto been assumed (Lindner, Tenside—Textilhilfsmittel—Waschrohstoffe, Vol. II, p. 1422 et seq), that it was the presence of the phosphate in the detergent acting in combination with stabilizers for the per compounds, in particular magnesium silicate and amino polycarboxylic acids such as the Trilon type, which was responsible for protecting fabrics when these were washed under boiling wash procedures in the presence of bleaching compounds which contained active oxygen, in particular sodium perborate.

The applicant found that, even without the addition of magnesium silicate and salts of aminopolycarboxylic acids such as ethylene diaminetetraacetate which is known to act as inhibitor of the decomposition of peroxide by heavy metal ions, the detergent according to the invention had a damaging factor of only 0.1–0.2 after 50 washes. By comparison, a high quality detergent which has a high phosphate content has a damaging factor of 0.4. As is well known (see Lindner, ibid. p. 1413), damaging factors below 0.4 are not regarded as harmful and even factors of up to about 1.0 are still acceptable.

It was also observed that even without the addition of magnesium silicate the stability of the perborate in the detergents according to the invention was greater than in conventional phosphate-containing detergents which also contained magnesium silicate.

The usual additions of 0.1% to 0.5% by weight of an aminopolycarboxylate, in particular ethylene diaminetetraacetate, to the usual phosphate based detergents suitable for boiling washes is unnecessary in the detergents according to the invention. Although this small proportion of polyaminocarboxylate in the known detergents cannot be regarded as significantly polluting the effluent, the fact that such additions may be dispensed with in the preparations according to the invention is of importance in the overall assessment of the detergent according to the invention, particularly when viewed in conjuction with the surprising finding that the special water-soluble organic complex former according to (c) used according to the invention, which is also added in only very small amounts, substantially below 1%, makes an important contribution to the powerful primary and secondary washing action of the detergent according to the invention. It may therefore be said viewed purely quantitatively, the complex forming salt used according to the invention takes the place of the complex forming salts of the amino polycarboxylate type hitherto normally used in detergents, and this exchange is therefore to be regarded as neutral in its environmental effect with regard to the pollution of effluent. With regard to the washing effect, however, the two types of complex formers differ from each other according to the teaching of this invention. If in the detergents according to this invention, the proportion of selected phosphonate according to (c) is replaced by the same quantity of an aminopolycarboxylate or of some other complex former for heavy metal ions, the important advantageous properties of the detergent according to this invention are not found in the resulting preparation. Thus, for example, when the detergent according to the invention is used for washing cotton textile samples, the remission values, which are a measure of the degree of whiteness retained, are higher by more than 20 units after 50 such washes than those obtained under similar conditions with a detergent which does not contain the phosphonate (c) defined above or in which the phosphonate has been replaced by an equal quantity of ethylene diaminetetraacetate. The remission values obtainable with the detergents according to this invention are therefore as high as those obtained with commercial phosphate-containing detergents. The phosphonates according to (c) are therefore sufficient as substantially the only soluble complex formers in the detergents according to the invention.

Suitable cation exchanging alkali metal aluminosilicates (a) are, in principle, the crystalline products described in the above-mentioned German Published Application DOS No. 2,412,837, which generally consist of particles below 50μ, mainly below 40μ and mostly within the range of from 20 to 0.1μ.

In the detergents according to the invention, it is advantageous to use crystalline sodium aluminosilicates having the composition, $0.7-1.1Na_2O.1.0Al_2O_3.1.3-2.4SiO_2$, which are also known as "zeolite NaA", especially those products of this composition and crystal structure which have been prepared under carefully selected conditions so that the resulting crystals have rounded edges and corners and a particle size below 30μ, with at least 80% of the particles measuring from 8 to 0.01μ and with the maximum range of the particle size distribution curve being from 3 to 6μ. Such aluminosilicates with rounded edges and corners are described in German Published Application DOS No. 2,531,342.

According to our observations, when the detergent according to the invention is used under boiling wash conditions in the washing machine, both the calcium ions and the magnesium ions in the wash water, which are generally present in proportions of Ca:Mg of approximately 5:1 in water with average degrees of hardness, are both bound by the aluminosilicate. Problem-free removal of the hardness due to calcium and to magnesium is still achieved in artifically prepared hot washing liquors having a degree of hardness of 16° and a proportion of calcium to magnesium ions of 1:1.

Accelerated removal of the magnesium hardness, already setting in at temperatures considerably below boiling, can also be achieved by using a sodium aluminosilicate according to (a) which has the composition, $0.7-1.35Na_2O.1.0Al_2O_3.1.3-2.4SiO_2$ and which consists of a binary mixture of from 40 to 90% of particles of zeolite NaA and from 10 to 60% of particles of zeolite HS (hydrosodalith). An aluminosilicate as defined above has a calcium binding capacity of from 100 to 165 mg of CaO/gm and a magnesium bind capacity of from 50 to 110 mg of MgO/gm at a temperature of only 50° C. in the washing liquor, the quantities given being based on the anhydrous substances. These aluminosilicate mixtures, their preparation and their use in detergents and cleaning agents have been described in German Published Application DOS No. 2,543,941.

The surface active component (b) contained in the detergents according to this invention preferably consists, in quantities of from 5% to 17% by weight, in particular of from 7% to 12% by weight, of a combination (ba) having the following composition:

(ba1) 1 Part by weight of at least one nonionic surface-active agent which is an ethoxylated aliphatic $C_{10}-C_{20}$ alcohol, preferably an alkanol or an alkenol, having a degree of ethoxylation of from 2 to 20;

(ba2) 0.3 to 1.75, preferably 0.3 to 1.0 parts by weight of a foam inhibiting alkali metal soap of $C_{12}-C_{22}$ fatty acids containing more than 50% by weight of alkali metal salts of saturated $C_{18}-C_{22}$ fatty acids, which soap may be partly replaced by a non-surface-active foam inhibitor in proportions of soap to non-surface-active foam inhibitor within the range of from 25:1 to 2:1; and (ba3) 0.5 to 6, preferably 0.8 to 4, parts by weight of an anionic surface-active agent of the sulfonate and/or sulfonate type.

Detergents according to the invention which contain a surface-active component according to (ba) show excellent lather control during the whole boiling wash program and rinsing, especially when used in drum type washing machines.

Particularly suitable for removing hydrophobic dirt are those lather controlled preparations according to the invention which contain the combination (bb) defined below as surface-active component (b), again in quantities of preferably from 5% to 17% by weight, more particularly from 7% to 12% by weight.

Combination (bb) consists of the following components:

(bb1) 1 Part by weight of at least one nonionic surface-active agent which is an ethoxylated aliphatic $C_{10}-C_{20}$ alcohol, preferably an alkanol or alkenol, having a degree of ethoxylation of from 2 to 20;

(bb2) 0.05 to 0.75 parts by weight of a foam inhibiting alkali metal soap of $C_{12}-C_{22}$ fatty acids containing more than 50% by weight of alkali metal salts of saturated $C_{18}-C_{22}$ fatty acids; and (bb3) 0.05 to 0.3, preferably 0.1 to 0.25 parts by weight of a compound corresponding to the following formula I:

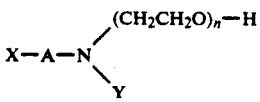

(I)

in which X-A represents a $C_{10}$–$C_{18}$ fatty acid acyl residue; or X represents a β-hydroxy-($C_8$–$C_{22}$)-alkyl residue in the terminal or non-terminal position, in which case A represents a simple C-N-valency or an aminoalkylene or polyaminopolyalkylene residue which may be substituted with polyethylene glycol ether groups; Y represents hydrogen or the group $-(CH_2CH_2O)_mH$ and n and m each represent numbers of from 1 to 3.

The anionic surface-active agents of the sulfonate and/or sulfonate type in the surface-active component (ba) preferably consist of alkylbenzene sulfonates and/or alkane sulfonates. The use of alkanesulfonates as washing agents in this surface-active component is particularly preferred in view of their rapid and complete biological degradation in the effluent and their low toxicity. It has surprisingly been found that, in detergents according to this invention, which contain a surface active component (ba) in which both an alkanesulfonate and optical brightening agents are present, the problems mentioned German Published Application DOS No. 2,504,276 of the incompatibility of alkanesulfonates with the usual optical brighteners of the type of 4,4'-bis(triazinylamino)-stilbene-2,2'-disulfonic acids used in detergents, which results in a greenish yellow to greyish yellow discoloration of the detergent powder in storage, does not occur. The use of alkanesulfonates as anionic surface-active agents in the detergent according to the present invention therefore does not require the use of special optical brighteners which are compatible with alkanesulfonates.

When the detergent according to the invention containing a surface-active component (ba) is used for boiling washes in drum washing machines, the protection against excessive foam formation during washing and rinsing is still provided if up to one third of the given quantities of alkylbenzene sulfonate and/or alkanesulfonate is replaced by more strongly foaming anionic surface-active agents of the type of α-sulfo fatty acid esters, olefin sulfonates, fatty alcohol sulfates and fatty alcohol polyglycol ether sulfates, which also have good biological degradability and low toxicity.

The nonionic surface-active agents contained in combinations (ba) and (bb) which are ethoxylated aliphatic $C_{10}$–$C_{20}$ alcohols having a degree of ethoxylation of from 2 to 20 preferably consist of binary mixtures of separately prepared ethylene oxide addition products which have average degrees of ethoxylation of, on the one hand, 2 to 7 mols EO (ethylene oxide) and, on the other hand, 8 to 20 mols EO and a ratio of compound with a low degree of ethoxylation to compound with a higher degree of ethoxylation within the range of from 3:1 to 1:3.

Preferred nonionic surface-active agents are those in which the aliphatic group is derived from primary alkanols and alkenols and which are obtained from natural and synthetic sources. Particularly preferred on account of their efficient biological degradability combined with ease of accessibility are the ethoxylation products of natural fatty alcohols, particularly those with $C_{12}$–$C_{18}$ alkyl and alkenyl groups.

Ethoxylation products of so-called oxoalcohols which are obtained from olefins by hydroformylation and hydrogenation and which are primary aliphatic alcohols containing an α-methyl branch, which does not impair biological degradability, are also preferred. The removal of hydrophobic dirt is improved if, in the two surface-active components (ba) and (bb) defined above, an ethoxylated fatty alcohol is replaced by an equal quantity of an ethoxylated oxo alcohol which contains the same proportion of hydrophobic to hydrophilic parts in the molecule.

Compounds (bb3) of formula I in the surface-active component (bb) are addition products of 1 mol of a low molecular weight amine having from 1 to 9 carbon atoms, and 1 to 4 nitrogen atoms and at least one labile hydrogen atom, in particular a mono- or di-ethanolamine, ethylene diamine, diethylene triamine or triethylene tetramine, and 1 mol of a $C_8$–$C_{22}$ epoxyalkane, in particular a $C_{10}$–$C_{18}$ epoxyalkane, having the epoxy group in either a terminal or non-terminal position, which addition products may also be ethoxylated. These compounds corresponding to formula I have already been proposed as additions to detergents to increase the washing power. Also to be included among compounds (bb3) of formula I are the ethanolamides of $C_8$–$C_{18}$ fatty acids, in particular the monoethanolamides. These compounds of formula I are therefore also to be regarded as nonionic surface-active agents in their widest sense.

The water-soluble organic complex formers from the group consisting of substituted alkane di- and triphosphonic acids according to (c), which also include heterocyclic substituted compounds, include in particular those alkane di- and triphosphonic acids and their alkali metal salts in which the alkane group has been substituted by hydroxyl, amino or phenyl groups or by a phenyl group which carries hydroxyl, amino or halogen groups. More particularly, these compounds are selected from the group consisting of (i) diphosphonates having the formula

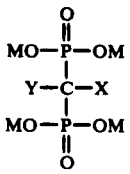

wherein X is a member selected from the group consisting of hydroxy and amino, Y is a member selected from the group consisting of alkane having from 1 to 5 carbon atoms, aminoalkane having from 2 t 5 carbon atoms, hydroxyalkane having from 2 to 5 carbon atoms, phenyl, hydroxyphenyl, aminophenyl and halophenyl and M is a member selected from the group consisting of hydrogen and alkali metal, and (ii) aminotri-(lower alkylene phosphonic acid) and its alkali metal salts. Particularly preferred alkane di- and triphosphonates are 1-hydroxyethane-1,1-diphosphonic acid, 1-aminoethane-1,1-diphosphonic acid; 3-amino-1-hydroxypropane-1,1-diphosphonic acid, 1-amino-1-p-chlorophenylmethane-1,1-diphosphonic acid; 1-hydroxy-1-p-chlorophenylmethane-1,1-diphosphonic acid, 1-hydroxy-1-phenylmethane-1,1-diphosphonic acid; 1-hydroxybutane-1,1-diphosphonic acid and aminotri-(methylene phosphonic acid) in the form of their alkali metal salts, in particular their sodium salts. Among these compounds, the sodium salts of 1-hydroxyethane-1,1-diphosphonic acid (HEDP), 1-hydroxybutane-1,1-diphosphonic acid (HBDP) and aminotri-(methylene phosphonic acid) (ATMP) are particularly preferred.

The inorganic per compounds (d) serving as bleaching agents in the detergent according to the invention are compounds which release hydrogen peroxide in water, primarily sodium perborate tetrahydrate ($NaBO_2.H_2O_2.3\ H_2O$) and sodium perborate monohydrate ($NaBO_2.H_2O_2$). Other borates which release hydrogen peroxide are also suitable, e.g. perborax $Na_2B_4O_7.4\ H_2O_2$. These per compounds may be partly or completely replaced by other compounds which contain active oxygen, for example, peroxy carbonate ($Na_2CO_3.1.5\ H_2O_2$).

As already mentioned above, the perborate-containing detergents according to this invention have a higher perborate stability, even without the usual stabilizers recommended for perborate-containing detergents, than the usual detergent compositions based on sodium tripolyphosphate which contain perborate and stabilizer. The stability of the perborates in the detergents according to the invention is hardly affected even by the presence of heavy metal ions such as copper ions which may occur in the washing liquor due to corrosion for example, in the water pipes.

The detergents according to the invention may in addition contain up to 7% by weight, preferably from 2% to 5% by weight, of water-soluble sodium silicates of the composition $Na_2O_2.1-3.5\ SiO_2$ as corrosion inhibitors, particularly those in which the proportion of $Na_2O:SiO_2$ is in the range of from 1:2 to 1:3.35.

The complete formulations of the detergents according to the invention generally contain from 1 to 50% by weight of other conventional additives which improve the use properties of the detergents, in particular soil suspending agents such as carboxymethylcellulose, enzymes, antimicrobial agents, optical brighteners, fabric softeners, coloring and perfuming substances, sodium sulfate as fillers, as well as water which is bound in the crystals of the water-soluble salts and particularly in the aluminosilicates and which may amount to about 2% to 18% by weight of the pourable washing powder.

Preferably detergents according to this invention generally correspond to the following composition:

(a) from 25% to 35% by weight of the water-insoluble, cation exchanging sodium aluminosilicate defined above, in particular one having the composition, $0.7-1.1\ Na_2O.Al_2O_3.1.3-2.4\ SiO_2$;

(b) from 5% to 17% by weight, in particular 2% to 12% by weight of one of the surface-active components (ba) or (bb) defined above;

(c) from 0.2% to 0.6% by weight of the water-soluble organic complex former from the group consisting of substituted alkane di- and triphosphonates according to the definition given above;

(d) from 15% to 30% by weight, in particular 20% to 25% by weight of sodium perborate, preferably in the form of the tetrahydrate;

(e) from 2% to 5% by weight of sodium silicate, $Na_2O.1-3.5\ SiO_2$;

(f) from 1% to 50% by weight of other conventional detergent additives from the group consisting of soil suspension agents, enzymes, antimicrobial agents, optical brighteners, fabric softeners, coloring and perfuming substances, sodium sulfate and water.

Preparation of the detergent according to the invention may be carried out by the usual methods, in the simplest case by thoroughly mixing all of the components at room temperature.

When preparing the detergents according to the invention the aluminosilicates (a) are preferably used in the still moist state from their preparation, for example as aqueous suspensions or moist filter cakes, and these moist aluminosilicates are preferably converted into stable, pumpable suspensions, optionally with further addition of water and with the addition of the dispersing agent. These pumpable suspensions contain from 25% to 40% by weight of the aluminosilicate, based on the quantity of anhydrous substance, and from 0.3% to 4% by weight of the dispersing agent.

In principle, the dispersing agents used are preferably compounds which are themselves effective detergent constituents, especially those which are already provided as components of the detergent according to the invention. Particularly preferred in the present invention as stabilizers for aqueous suspensions of aluminosilicates are the ethoxylated aliphatic $C_{10}-C_{20}$ alcohols with an average degree of ethoxylation of from 2 to 7 mols EO which are preferably contained in the surface-active components (ba) and (bb) or the compound of formula I used as constituent (bb3) in the combination (bb). Pumpable stable aluminosilicate suspensions containing, inter alia, ethoxylated alcohols such as tallow alcohol plus 5 mol of ethylene oxide or fatty acid ethanolamides such as lauric acid monoethanolamide as dispersing agents are described in detail in German Published Application DOS No. 2,527,388 and U.S. Pat. No. 4,072,622. The adducts of epoxyalkanes and low molecular weight amines corresponding to formula (I) defined above, which adducts may be ethoxylated, have also already been proposed as dispersing agents for aluminosilicate suspensions.

The suspensions prepared by mixing aluminosilicate, water and dispersing agent are distinguished by their high stability. They may be stored at room temperature or higher temperatures and transported through pipes or in tank trucks or by other means before they are processed into the detergents according to the invention. This processing into pourable, pulverulent detergents according to the invention is generally carried out by adding to the previously prepared suspensions of aluminosilicate, the other components of the detergent according to the invention with the exception of those components which are not stable to heat and moisture, particularly the sodium perborate, subjecting the resulting aqueous, fluid preliminary mixture to a process of spray drying and then mixing the resulting powder product with the perborate and optionally other constituents which are suitably not present during the process of spray drying, such as enzymes and perfumes. If the aliphatic alcohols with a low degree of ethoxylation which constitute part of the surface-active components and the compounds of formula I of the surface-active component (bb) have not been completely used for preparing the suspension, it is advisable, in view of the fact that in most cases they have a viscous liquid consistency, to add them subsequently to the powder product, either by spraying them into the powder which has been prepared by spray drying or by using the sodium perborate as carrier for these compounds.

Another preferred variation of the method of preparing the detergents according to the invention consists of using the aluminosilicates according to (a) in the form of a powder which feels dry but contains varying quantities of bound water, depending on the drying temperature employed, optionally together with sodium perborate, as solid carrier for the liquid or viscous constituents of the detergent according to the invention, in particular for the nonionic surface-active agents according to (ba1) or (bb1) and the compounds according to (bb3). These compounds are converted into pourable preliminary mixtures by spraying their solutions in volatile organic solvents or their solvent-free melts on to the solid carriers, and these preliminary mixtures are then mixed in the usual manner with the other pulverulent constituents of the detergent which is to be produced. Such preliminary mixtures and methods of preparing them are described in detail in German Published Application DOS No. 2,507,926, corresponding to U.S. Pat. No. 4,136,051.

As already mentioned above, the aluminosilicates used are synthetic crystalline products, although mixtures of crystalline and amorphous products or partly crystalline products may, of course, also be used for the purpose of this invention.

Preparation of the aluminosilicate may be carried out by, for example, reacting water-soluble silicates with water-soluble aluminates in the presence of water. For this purpose, aqueous solutions of the starting materials may be mixed together or one component in the solid state may be reacted with the other component used as aqueous solution. The desired aluminosiliates may also be obtained by mixing the two solid components in the presence of water. Aluminosilicates may also be prepared from $Al(OH)_3$, $Al_2O_3$ or $SiO_2$ by reaction with alkali silicate or alkali metal aluminate solution, respectively. The preparation may also be carried out by other known methods.

Preferred aluminosilicates have a calcium binding capacity approximately within the range of from 100 to 200 mg CaO/gm AS, in most cases approximately 100 to 180 mg CaO/gm AS. This is found mainly in compounds having the composition, 0.7–1.1 $Na_2O.Al_2O_3$.1.3–3.3 $SiO_2$.

This overall formula covers two types of crystal structures which differ from each other by their separate overall formulae, as follows:

$$0.7\text{–}1.1\ Na_2O.Al_2O_3.1.3\text{–}2.4\ SiO_2 \quad \text{(i)}$$

$$0.7\text{–}1.1\ Na_2O.Al_2O_3.>2.4\text{–}3.3\ SiO_2. \quad \text{(ii)}$$

The different crystal structures show up in the X-ray diffraction diagram. For the preparation, identification and use for washing and cleaning purposes of these types of aluminosilicate also known as zeolites NaA and NaX, see German Published Application DOS No. 2,412,837.

The aluminosilicates still moist or wet with water from their preparation, which may be in the form of aqueous suspensions or moist filter cakes, may be converted into dry powders by the usual method of first removing part of the water mechanically and then drying them, e.g. at temperatures of from 50° to 400° C. The powder product, which outwardly seems dry, contains varying quantities of bound water, in most cases from 5% to 35% by weight, depending on the conditions employed from drying. The temperatures employed for drying preferably do not exceed 200° C., if the aluminosilicate is intended to be used in washing and cleaning agents. However, the aluminosilicates need not be dried at all after they have been prepared if, according to the teaching of U.S. Pat. No. 4,072,622 they are converted into a stable suspension by treatment with a certain dispersing agent and water and this suspension is then used for further processing into detergents. Apart from the saving in energy due to elimination of the drying stage, this method of processing eliminates virtually completely the agglomeration of primary particles to undesirably large particles (secondary particles), which is observed when the usual methods of drying are employed, which therefore necessitate subsequent milling and screening.

All the figures given for the water content, solids content and amount of active substance (=AS) in the aluminosilicates are based on the composition of the aluminosilicate after one hour's drying at 800° C. This heat treatment removed virtually all of the bound water and water adhering to the aluminosilicate. This reference value of aluminosilicate dried for one hour at 800° C. is particularly important for determing the calcium binding capacity.

The calcium binding capacity of the aluminosilicates is determined by adding 1 gm of aluminosilicate (based on the quantity of AS) to 1 liter of an aqueous solution which contains 0.594 gm of $CaCl_2$ (=300 mg CaO/l=30° dH) and which has been adjusted to pH 10 with dilute sodium hydroxide, and then vigorously stirring the suspension for 15 minutes at a temperature of 22° C., 50° C. and 90° C., respectively. After removal of the aluminosilicate by filtration, the residual hardness x of the filtrate is determined. The calcium binding capacity of the aluminosilicate is calculated from this value as (30 - x).10 mg CaO/gm AS. For shorthand purposes this test procedure will be referred to as the Calcium Binding Power Test Method.

The magnesium binding capacity is determined in similar manner on an aqueous solution containing 1.0877 gm of $MgCl_2.6\ H_2O$ per liter (=215 mg MgO/l=30° d MgO). The magnesium binding capacity is calculated as (30 - x).7.19 mg of MgO/gm AS. For shorthand purposes this test procedure will be referred to as the Magnesium Binding Power Test Method.

The particle sizes of the aluminosilicates may be determined by, for example, sedimentation analysis.

The surface-active agents or tenside contained in the detergents according to this invention have at least one hydrophobic organic residue and one water-solubilizing anionic, amphoteric or zwitterionic or nonionic group in the molecule. The hydrophobic residue is, in most cases, an aliphatic hydrocarbon residue, such as alkyl or alkenyl, having from 8 to 26, preferably from 10 to 22 and more particularly from 12 to 18 carbon atoms, or an alkylaromatic residue, such as alkylphenyl or alkylnaphthyl, having from 6 to 18, preferably from 8 to 16, carbon atoms in the alkyl.

Particularly suitable synthetic anionic surface-active agents are those of the sulfonate and sulfate type.

Suitable sulfonate type surface-active agents are, above all, the alkylbenzene sulfonates containing $C_9$–$C_{15}$ alkyl groups and alkanesulfonates which are obtainable from $C_{12}$–$C_{18}$ alkanes by sulfochlorination or sulfoxidation followed by hydrolysis or neutralization or by bisulfite addition to olefins. Other suitable surface-active agents of the sulfonate type include esters of α-sulfo-fatty acids, e.g., α-sulfonated methyl or ethyl esters of hydrogenated coconut, palm kernel or tallow fatty acids as well as olefin sulfonates, i.e., mixtures of alkene sulfonates and hydroxyalkane sulfonates, as well as alkane disulfonates, such as may be obtained, for example, from monoolefins having a double bond in a terminal or non-terminal position by sulfonation with gaseous sulfur trioxide followed by alkaline or acid hydrolysis of the sulfonation products.

Suitable surface-active agents of the sulfate type include sulfuric acid monoesters of naturally occurring or synthetic primary alcohols, particularly alkanols and alkenols, i.e., fatty alcohols such as coconut fatty alkanols, tallow fatty alkanols, oleyl alcohol, lauryl alcohol, myristyl alcohol, palmityl alcohol or stearyl alcohol, or $C_{10}$–$C_{20}$ oxo alcohols as well as secondary alcohols which have this chain length, such as $C_{10}$–$C_{20}$ sec. alkanols.

Sulfuric acid monoesters of ethoxylated aliphatic primary alcohols which have been ethoxylated with 1 to 6 mols of ethylene oxide and of ethoxylated secondary alcohols or ethoxylated alkylphenols are also suitable. Sulfated fatty acid alkanolamides and sulfated fatty acid monoglycerides may also be used.

The anionic surface-active agents may be in the form of their alkali metal salts, such as sodium and potassium, or ammonium salts or soluble salts of organic bases, such as mono-, di- or triethanolamine.

The nonionic surface-active agents which may be used according to the invention are addition products of from 1 to 40, preferably 2 to 20, mols of ethylene oxide to 1 mol of an aliphatic compound having a replaceable hydrogen atom and containing in the main 10 to 20 carbon atoms, taken from the group consisting of alkanols, alkenols, alkylphenols, alkanoic acids and alkenoic acids. Particularly important are the addition products of from 8 to 20 mols of ethylene oxide to primary fatty alcohols, such as coconut fatty alcohols or tallow fatty alcohols, oleyl alcohol or oxo alcohols of the same chain lengths or to corresponding secondary alkanols or to monoalkyl or dialkylphenols having from 6 to 14 carbon atoms in the alkyl groups. Apart from these water-soluble nonionic surface-active agents, polyalkylene glycol ethers which are insoluble or not completely soluble in water and which have from 2 to 7 ethylene glycol ether groups in the molecule are also of interest, particularly if they are used in combination with water-soluble nonionic or anionic surface-active agents. Ethoxylation products of primary aliphatic alkanols and alkenols are particularly interesting from a practical point of view on account of their good biological degradability.

Typical representatives of nonionic surface-active agents with an average degree of ethoxylation of 2 to 7 which may be used according to the invention include, for example:

coconut fatty alcohol + 5 EO (EO-ethylene oxide)
tallow fatty alcohol + 5 EO
oleyl/cetyl alcohol + 5 EO (iodine number 30 to 50)
tallow fatty alcohol + 7 EO
synthetic $C_{12}$–$C_{16}$ fatty alcohol + 6 EO
$C_{11}$–$C_{15}$-oxo alcohol + 3 EO
$C_{14}$–$C_{15}$-oxo alcohol + 7 EO
i-$C_{15}$–$C_{17}$-alkanediol + 5 EO (i = nonterminal vicinal position)
and sec.-$C_{11}$–$C_{15}$-alkanol + 4 EO.

Examples of nonionic surface-active agents having an average degree of ethoxylation from 8 to 20, in particular from 9 to 15, include the following compounds:

coconut fatty alcohol + 12 EO
synthetic $C_{12}$–$C_{14}$-fatty alcohol + 9 EO
oleyl/cetyl alcohol + 10 EO
tallow fatty alcohol + 14 EO
$C_{11}$–$C_{15}$-oxo alcohol + 13 EO
$C_{15}$–$C_{18}$-oxo alcohol + 15 EO
i-$C_{15}$–$C_{17}$-alkanediol + 9 EO
$C_{14}$–$C_{15}$-oxo alcohol + 11 EO
and sec. $C_{11}$–$C_{15}$-alkanol + 9 EO.

Water-soluble addition products containing from 20 to 250 ethylene glycol ether groups and from 10 to 100 propylene glycol ether groups and obtained by the addition of ethylene oxide to polypropylene glycol, to alkylene diamine-polypropylene glycol and to alkyl polypropylene glycols which have from 1 to 10 carbon atoms in the alkyl chain may also be used as nonionic surface-active agents. In these compounds, the polypropylene glycol chain functions as hydrophobic residue. Nonionic surface-active agents of the aminoxide or sulfoxide type may also be used, for example, N-coconut alkyl-N,N-dimethyl-aminoxide, N-hexadecyl-N,N-bis-(2,3-dihydroxypropyl)-aminoxide, and N-tallow alkyl-N,N-dihydroxyethyl-aminoxide.

The amphoteric surface-active agents are compounds which contain both an anionic and a cationic group in the same molecule. Suitable compounds include derivatives of aliphatic $C_8$–$C_{18}$ amines which contain a water-solubilizing group, e.g., a carboxyl, sulfo or sulfate group. Typical representatives of amphoteric surface-active agents include the sodium salts of 2-dodecylamino-propionic acid and 3-dodecylaminopropane sulfonic acid and similar compounds, e.g., sulfated imidazoline derivatives.

The zwitterionic surface-active agents used are preferably derivatives of aliphatic quaternary ammonium compounds in which one of the aliphatic groups is a $C_8$–$C_{18}$ group and another contains an anionic, water-solubilizing carboxyl, sulfo or sulfate group. The following compounds are examples of typical representatives of such surface-active betaines:

3-(N-hexadecyl-N,N-dimethyl-ammonio)-propanesulfonate
3-(N-tallow alkyl-N,N-dimethyl-ammonio)-2-hydroxypropanesulfonate
3-[N-hexadecyl-N,N-bis-(2-hydroxyethyl)-ammonio]-2-hydroxypropylsulfate
3-[N-coconut alkyl-N,N-bis-(2,3-dihydroxypropyl)-ammonio]-propanesulfonate
N-tetradecyl-N,N-dimethyl-ammonio-acetate
N-hexadecyl-N,N-bis-(2,3-dihydroxypropyl)-ammonio-acetate.

The foam inhibiting additives may be foam suppressing soaps and non-surface-active foam inhibitors. The foam suppressing action of soaps generally increases with the degree of saturation and the number of carbon atoms in the fatty acid residue, so that soaps of natural and synthetic origin which contain a high proportion of $C_{18}$–$C_{22}$ fatty acids are particularly suitable as foam inhibiting soaps, for example, the derivatives of hydrogenated fish train oils and rape oils. In practice, one would generally use fatty acid mixtures containing from $C_{12}$–$C_{22}$ carbon chains, at least 50% of which consist of $C_{18}$–$C_{22}$ fatty acid salts (iodine number $<5$).

The non-surface-active foam inhibitors which may be used alone or together with the foam inhibiting soaps are generally water-insoluble compounds, in most cases containing aliphatic $C_8$–$C_{22}$ carbon residues. Suitable non-surface-active foam inhibitors include, for example, N-alkylaminotriazines, i.e., reaction products of 1 mol of cyanuric chloride with 2 to 3 mols of a monoalkylamine or dialkylamine containing mainly 8 to 18 carbon atoms in the alkyl group. Propoxylated and/or butoxylated aminotriazines are also suitable, for example, the reaction products of 1 mol of melamine with 5 to 10 mols of propylene oxide and in addition 10 to 50 mols of butylene oxide, as well as aliphatic $C_{18}$–$C_{40}$ alkanones, such as stearone, fatty ketones of hardened train oil fatty acid or tallow fatty acid, etc. as well as paraffins and halogenated paraffins with melting points below 100° C. and polymeric organic silicon compounds of the type of silicone oils.

In the detergents according to the invention which contain the surface-active combination (bb), the compounds corresponding to Formula I, insofar as they are hydroxyalkylamines (in Formula I, X represents a β-hydroxyalkyl group and A a single C—N bond) are mainly compounds which have been prepared by a single stage or two-stage reaction from terminal or non-terminal epoxyalkanes by first reacting these with mono- or diethanolamine or mono- or di-isopropanolamine or with ammonia, an alkylene diamine, a polyalkylene polyamine or a hydroxyalkylpolyamine and then optionally ethoxylating the resulting addition products in a second reaction stage.

The epoxyalkanes used as starting materials are prepared from the corresponding olefins or olefin mixtures by known methods.

The terminal epoxyalkanes used for the preparation of hydroxyalkylamines of Formula I preferably have chain lengths of from $C_{12}$–$C_{18}$.

Preferred non-terminal mono-olefins used to make the non-terminal epoxyalkanes are of a $C_{11}$–$C_{14}$ fraction and a $C_{15}$–$C_{18}$ fraction had the following chain length distribution:

$C_{11}$–$C_{14}$ Fraction:
- $C_{11}$-olefins about 22% by weight
- $C_{12}$ olefins about 30% by weight
- $C_{13}$ olefins about 26% by weight
- $C_{14}$ olefins about 22% by weight;

$C_{15}$–$C_{18}$ Fraction:
- $C_{15}$ olefins about 26% by weight
- $C_{16}$ olefins about 35% by weight
- $C_{17}$ olefins about 32% by weight
- $C_{18}$ olefins about 7% by weight.

The following compounds are examples of typical hydroxyalkylamines corresponding to Formula I (turbidity points determined in aqueous butyl diglycol according to DIN 53917):

(1) The reaction product of a non-terminal $C_{11}$–$C_{14}$ epoxyalkane and diethanolamine; turbidity point <0° C.

(2) The reaction product of a non-terminal $C_{11}$–$C_{14}$ epoxyalkane and monoethanolamine; turbidity point 34° C.

(3) The reaction product of a non-terminal $C_{11}$–$C_{14}$ epoxyalkane and bis-hydroxyethoxyethylamine; turbidity point 44° C.

(4) The reaction product of a non-terminal $C_{11}$–$C_{14}$ epoxyalkane and diethanolamine, in addition ethoxylated with 1 mol of ethylene oxide; turbidity point 32° C.

(5) The reaction product of a non-terminal $C_{11}$–$C_{14}$ epoxyalkane and diethanolamine, in addition ethoxylated with 2 mols of ethylene oxide; turbidity point 45° C.

(6) The reaction product of a non-terminal $C_{11}$–$C_{14}$ epoxyalkane and ethylenediamine, in addition reacted with 4 mols of ethylene oxide; turbidity point 72.5° C.

(7) The reaction product of α-epoxyoctane and ethylene diamine; turbidity point 15° C.

Those compounds corresponding to Formula I in the surface-active combination (bb) which are fatty acid ethanolamides (in Formula I, X-A denotes a fatty acid residue) are preferably fatty acid monoethanolamides obtained from individual fatty acids or from fatty acid mixtures, particularly those with chain lengths of from $C_{10}$–$C_{18}$. These fatty acids or mixtures may be of natural or synthetic origin. The fatty acids may be saturated or unsaturated. Monoethanolamides of mixed fatty acids obtained from natural sources are particularly suitable, for example, the monoethanolamides of coconut fatty acids, palm kernel fatty acids or tallow fatty acids. The following compounds are examples of such fatty acid monoethanolamides:

lauric acid monoethanolamide
coconut fatty acid monoethanolamide
myristic acid monoethanolamide
palmitic acid monoethanolamide
stearic acid monoethanolamide
oleic acid monoethanolamide
and tallow fatty acid monoethanolamide.

The detergents may contain optical brighteners for cotton, in particular, derivatives of diaminostilbenedisulfonic acid or alkali metal salts thereof. Suitable compounds include, for example, salts of 4,4'-bis-(2-anilino-4-morpholino-1,3,5-triazin-6-yl-amino)-stilbene-2,2'-disulfonic acid or compounds which have a similar structure but carry a diethanolamino group, a methylamino group or a 2-methoxyethylamino group instead of the morpholino group. Suitable brighteners for polyamide fibers include those of the 1,3-diaryl-2-pyrazoline type, for example, the compound 1-(p-sulfamoylphenyl)-3-(p-chlorophenyl)-2-pyrazoline and compounds having a similar structure but containing, instead of the sulfamoyl group, e.g., the methoxycarbonyl, 2-methoxyethoxycarbonyl, acetylamine or vinyl sulfonyl group. Substituted aminocoumarins are also suitable polyamide brighteners, e.g., 4-methyl-7-dimethylaminocoumarin or 4-methyl-7-diethylaminocoumarin. 1-(2-Benzimidazolyl)-2-(1-hydroxyethyl-2-benzimidazolyl)-ethylene and 1-ethyl-3-phenyl-7-diethylamino-carbostyryl may also be used as polyamide brighteners. Compounds which are suitable brightening agents for polyester and polyamide fibers include 2,5-di-(2-benzoxazolyl)-thiophene, 2-(2-benzoxazolyl)-naphtho-[2,3-b]-thiophene, and 1,2-di-(5-methyl-2-benzoxazolyl)-ethylene. Brighteners of the substituted 4,4'-distyryl-diphenyl type may also be present, e.g., 4,4'-bis-(4-chloro-3-sulfostyryl)-diphenyl. Mixtures of the brightening agents mentioned above may also be used.

The preparations may also contain soil suspension agents which prevent greying by keeping the dirt which has been released from the fibers in suspension in the washing liquor. Water-soluble colloids, mostly of an organic nature, are suitable for this purpose, for example, water-soluble salts of polymeric carboxylic acids, glue, gelatin, salts of ether carboxylic acids or ether sulfonic acids of starch or of cellulose or salts of acid sulfuric acid esters of cellulose or of starch. Water-soluble polyamides which contain acid groups are also suitable for this purpose. Carboxymethylated cellulose or starch in the form of its sodium salts are preferred. Soluble starch preparations and starch products other than those mentioned above, e.g., degraded starches and aldehyde starches, are also suitable, and polyvinyl pyrrolidone may also be used.

The following examples are illustrative of the invention without being limitative in any respect.

EXAMPLES

One method of preparation for the aluminosilicates is first given. Other known methods of preparing aluminosilicates may also be employed.

The sodium silicate solution was added to the sodium aluminate solution with vigorous stirring in a vessel having a capacity of from 15 to 20 liters. A stirrer with dispersing disc rotating at 3000 revs/min was employed. Both solutions were at room temperature. An exothermic reaction took place and a sodium aluminosilicate which was amorphous according to X-ray analysis was formed as primary precipitation product. After ten minutes of stirring, the suspension of the precipitation product was transferred to a crystallization vessel where it was crystallized by heating to 80° C. to 130° C. for one to 24 hours with stirring (250 to 500 revs/min). After separation of the crystal paste from the liquor by suction filtration and washing with deionized water until the wash waters from the paste had a pH of about 10 to 11, the filter cake was either dried, e.g., at 100° C. for 24 hours, and then crushed to a fine powder or the aluminosilicate was used in the form of an aqueous paste, preferably an aqueous suspension, to prepare the detergent or cleaning agent. Specific data for the temperature, heating time and method of working up are given below in the methods of preparation for the individual types of aluminosilicates given as representative examples.

| | |
|---|---|
| Aluminosilicate Im: | |
| Reaction mixture for preparing the precipitate: | 2.985 kg of aluminate solution having the following composition:<br>17.7% $Na_2O$<br>15.8% $Al_2O_3$<br>66.5% $H_2O$<br>0.150 kg caustic soda<br>9.420 kg water, and<br>2.445 kg of a 25.8% solution of sodium silicate of the composition 1 $Na_2O$ . 6 $SiO_2$ freshly prepared from a commerical waterglass and a readily alkali-soluble silicic acid |
| Precipitation: | The suspension of amorphous precipitation product was stirred with a high speed stirrer (10,000 revs/min) for ten minutes. |
| Crystallization: | Six hours at 90° C. |
| Drying: | 24 hours at 100° C. |
| Composition: | 0.9 $Na_2O$ . 1 $Al_2O_3$ . 2.04 $SiO_2$ . 4.3 $H_2O$ (= 21.6% $H_2O$). |
| Degree of crystallization: | Completely crystalline. |
| Calcium binding capacity at 22° C.: | 170 mg CaO/gm AS. |
| Particle size (by sedimentation analysis): | 100% below 40 μ<br>85% to 95% below 10 μ. |
| Maximum range of particle size distribution: | 3 to 6 μ. |
| Aluminosilicate R1: | |
| Precipitation: | 7.63 kg of an aluminate solution having the composition:<br>13.2% $Na_2O$<br>8.0% $Al_2O_3$<br>78.8% $H_2O$<br>2.37 kg of sodium silicate solution having the composition:<br>8.0% $Na_2O$<br>26.9% $SiO_2$<br>65.1% $H_2O$ |

-continued

| | |
|---|---|
| Molar ratios in the reaction mixture: | 3.24 $Na_2O$, 1.0 $Al_2O_3$<br>1.78 $SiO_2$, 70.3 $H_2O$. |
| Crystallization: | 6 hours at 90° C. |
| Drying: | 24 hours at 100° C. |
| Composition of the dried product: | 0.99 $Na_2O$ . 1.0 $Al_2O_3$ . 1.83 $SiO_2$ . 4.0 $H_2O$ (= 20.9% $H_2O$). |
| Crystal form: | Cubical with strongly rounded edges and corners. |
| Average particle diameter (for the range 0 to 30 μ) | 5.4 μ. |
| Maximum range of particle size distribution: | Below 3 μ. |
| Calcium binding capacity at 22° C.: | 172 mg CaO/gm AS. |
| Aluminosilicate F1 | |
| Precipitation: | 7.31 kg of aluminate having the composition:<br>14.8% $Na_2O$<br>9.2% $Al_2O_3$<br>76.0% $H_2O$<br>2.69 kg of silicate having the composition:<br>8.0% $Na_2O$<br>26.9% $SiO_2$<br>65.1% $H_2O$ |
| Molar ratios in the reaction mixture: | 3.17 $Na_2O$ 1.0 $Al_2O_3$<br>1.82 $SiO_2$ 62.5 $H_2O$. |
| Crystallization: | 6 hours at 90° C. |
| Composition of the dried product: | 1.11 $Na_2O$ . 1.89 $SiO_2$ . 3.1 $H_2O$ (= 16.4% $H_2o$). |
| Crystal structure: | Mixture of zeolite NaA and zeolite HS in proportions of about 1:1. |
| Crystal form: | Rounded crystallites. |
| Average particle diameter (for the range 0 to 30 μ | 5.6 μ. |
| Maximun range of particle size distribution: | Below 3 μ. |
| Calcium binding capacity: | 105 mg CaO/gm AS at 50° C.,<br>120 mg CaO/gm AS at 90° C. |
| Magnesium binding capacity: | 15 mg MgO/gm AS at 22° C.,<br>96 mg of MgO/gm AS at 90° C. |

Now follows the description of the washing and cleaning detergents according to the invention. The salt type constituents of the detergents mentioned in the Examples, i.e. surface-active agents in the form of salts and other organic salts as well as inorganic salts, are the sodium salts unless specifically indicated to be otherwise. All percentages are percentages by weight. In the examples of detergents, the quantity of aluminosilicate given is based on "active substance", i.e. on the anhydrous product. The proportion of water bound in the aluminosilicate is included with the remaining water content of the detergent. The terms and abbreviations used in the Examples have the following meaning:

| | |
|---|---|
| "ABS": | The salt of an alkylbenzene sulfonic acid having from 10 to 15, in most cases from 11 to 15 carbon atoms in the alkyl chain, obtained by the condensation of straight chain olefins with benzene followed by sulfonation of the resulting alkylbenzene. |
| "Alkanesulfonate": | A sulfonate obtained by sulfoxidation of $C_{12}$—$C_{18}$ paraffins. |
| "Fs-ester sulfonate": | A sulfonate obtained from the methyl ester of hydrogenated palm kernal fatty acid by sulfonation with $SO_3$. |

-continued

| | |
|---|---|
| "Olefin sulfonate": | A mixture of hydroxyalkane sulfonates, alkene sulfonates and alkane disulfonates obtained by the sulfonation of α-olefins having from 12 to 18 carbon atoms with sulfur trioxide and hydrolysis of the sulfonation product with sodium hydroxide solution. |
| "Coconut alcohol sulfate": | A sulfate obtained by sulfonating the $C_{12}/C_{14}$ fraction of coconut fatty alcohol. |
| "Tallow alcohol + 3-EO-sulfate": | A sulfate obtained by sulfating an ethoxylated tallow fatty alcohol having an average degree of ethoxylation of 3. |
| "TA + x EO", "KA + x EO", "OCA + x EO", "OXO + EO": | The addition products of x mols of ethylene oxide (EO) with 1 mol of commerical tallow fatty alcohol (TA) or of coconut fatty alcohol (KA) or of oleyl/cetyl alcohol (iodine number 50) (OCA) or of a $C_{14}/C_{15}$ oxo alcohol having a degree of α-methyl branching of ca. 20%(OXO). |
| "Soap": | A soap (iodine number = 1) prepared from a hardened mixture of equal parts by weight of tallow fatty acid and rape oil fatty acid. |
| "Foam inhibitor": | Silicone oil "SAG 100" ® of Union Carbide and Carbon. |
| "i-11-14-DAA": | The reaction product of a non-terminal $C_{11}$—$C_{14}$-epoxyalkane and diethanolamine. |
| "i-11-14-MAA": | The reaction product of a non-terminal $C_{11}$—$C_{14}$-epoxyalkane and monoethanolamine. |
| "i-11-14-DAA + 1 EO": | The reaction product of a non-terminal $C_{11}$—$C_{14}$-epoxyalkane and diethanolamine in addition reacted with 1 mol of ethylene oxide. |
| "HEDP": | The salt of 1-hydroxyethane-1,1-diphosphonic acid. |
| "HBDP": | The salt of 1-hydroxybutane-1,1-diphosphonic acid. |
| "Perborate": | A commerical product having the approximate composition: $NaBO_2 . H_2O_2 . 3 H_2O$. |
| "Waterglass": | A sodium silicate having the composition: $Na_2O . 3.35 SiO_2$. |
| "CMC": | The salt of carboxymethylcellulose. |
| "EDTA": | The salt of ethylenediamine-tetraacetic acid. |
| "ATMP": | The salt of aminotri-(methylene phosphonic acid). |
| "Brightening agent": | The salt of 4,4'-bis-(2-anilino-4-morpholino-1,3,5-triazin-6-yl-amino)-stilbene-2,2'-disulfonic acid. |
| "Enzyme": | A commerical enzyme mixture of proteases and amylases (Maxatase ®). |

EXAMPLE 1

This example describes the determination of the average degree of polymerization (DP-degree) and the damaging factor resulting therefrom. This damaging factor is a measure of the extent to which a detergent protects the fabric after repeated washing. Washing tests were carried out in the form of so-called strand washing tests. The test fabrics used were samples, amounting to 10 gm or 20 gm, of a bleached nettle cloth from which the finish had been removed, and an equal quantity of a strand of rayon flock was used as filling material. The washing tests were carried out in beakers under boiling conditions. Bath ratio 1:10, hardness of water 12° dH (German hardness), washing time 15 minutes at boiling temperature. The samples were washed 50 times with detergent doses of 5.0 gm/l. They were rinsed three times with water of the same hardness and rung out by hand.

After drying of the strips of cotton samples, the average degree of polymerization was determined by viscosity measurements by the Cuoxam method (Melliand Testilberichte, XXXIII, 1952, pages 153–156) and the damaging factor was calculated from the average degree of polymerization (Melliand Textilberichte, XXII, 1941, pages 424–426).

The tests were carried out using a detergent of the following composition (Detergent 1 a):

5.5% by weight ABS,
2.0% by weight TAt14 EO,
2.5% by weight soap,
30.0% by weight aluminosilicate R 1,
4.0% by weight waterglass,
0.2% by weight HEDP,
20.0% by weight perborate,
1.0% by weight CMC,
Remainder sodium sulfate and water.

The results were compared with those obtained with a phosphate-containing detergent which, instead of 30% by weight of aluminosilicate, contained 25% by weight of sodium tripolyphosphate and 5% by weight of sodium carbonate (detergent 1 b) and with a detergent which had the same composition of 1 b but in addition contained 1% by weight of magnesium silicate (detergent 1 c). The results were also compared with those obtained with a conventional commercial boiling detergent containing about 40% by weight of sodium tripolyphosphate, 25% by weight of perborate, 2% by weight of magnesium silicate and about 10% by weight of surface-active agents (detergent 1 d). The figures for the calculated damaging factors given in the Table below show the surprising result that the damaging factor of detergent 1*a* according to the invention is far below that of comparison preparations 1 b and 1 c and that it is even more advantageous than that of the fabric-protecting preparation 1 d.

TABLE 1

| Detergent according to Example 1 | 1 a | 1 b | 1 c | 1 d |
|---|---|---|---|---|
| Damaging factor s | 0.18 | 1.95 | 0.94 | 0.40 |

EXAMPLE 2

In this example, the degree of whiteness retention of cotton test fabrics after 50 washes is tested with detergent 2 a according to the invention, which has the following composition:

Detergent formulation 2 a 5.5% by weight alkane sulfonate,
2.0% by weight KA + 12 EO,
2.5% by weight soap,
30.0% by weight aluminosilicate Im,
4.0% by weight waterglass,
0.5% by weight HEDP,
20.0% by weight perborate,
1.0% by weight CMC,
Remainder: sodium sulfate and water.

The detergent was compared with a phosphate-containing detergent which contained 25% by weight of sodium tripolyphosphate and 5% by weight of sodium carbonate instead of the 30% by weight of aluminosilicate; as well as the 0.5% by weight of HEDP had been replaced by the same quantity of EDTA (detergent 2 b). It was also compared with a detergent which had the same composition as preparation 2 a except that it contained 0.5% by weight of EDTA instead of 0.5% by weight of HEDP (detergent 2c).

The washing tests were analogous to the strand washing tests described in Example 1. To assess the greying of the fabric, dilute Indian ink (1:100) was added in a quantity of 2 cc per liter before each wash as "dirt". The degree of whiteness of the washed fabrics was then determined with a remission measuring instrument (Elrepho manufactured by Zeiss, Oberkochen, Germany). The results given in Table 2 below are average values obtained from four results. The figures given in this table show that with the addition of only 0.5% by weight of HEDP, a remission value results which differs only slightly from that obtained with the phosphate containing detergent tested for comparison, whereas the remission value obtained with the product which is free from HEDP is lower by more than 30 units. Similar effects are also obtained when HEDP is replaced by an equal quantity of HBDP or the other substituted diphosphonates which may be used according to the invention.

TABLE 2

| Detergent according to Example 2 | 2a | 2b | 2c |
|---|---|---|---|
| % Remission after 50 washes (Elrepho Filter 6) | 89.8 | 93.6 | 58.3 |

EXAMPLE 3

To determine the stability of perborate, a detergent 3a according to the invention, which is identical to detergent 1a in Example 1, was compared with a detergent 3b which was similar in composition to detergent 3a but in addition contained (instead of 1% of sodium sulfate) 1% of magnesium silicate. A washing liquor containing 5 gm/l of preparation 3a or 3b, in which the water had a degree of hardness of 12° dH, was heated from 20° C. to 90° C. for 30 minutes and maintained at 90° C. for 15 minutes. The active oxygen content of the solution was determined at 50° C., 75° C., 80° C. and 90° C. and after 15 minutes at 90° C. In both cases, the values of 100% had merely dropped to 98% at 90° C. whereas in a washing liquor which contained 5 gm/l of preparation 1c (see Example 1), the final value for the active oxygen content was 92%. In a preparation which had a similar composition but was free from magnesium silicate, the final value was 67%. This comparison clearly shows that the preparations according to the invention which have no magnesium silicate content have a higher stability of perborate than the phosphate-containing preparations compared with them, both with and without magnesium silicate.

When 0.2 mg of copper ions (in the form of copper sulfate) were added per liter of washing liquor, preparation 3a according to the invention was found to have a residual active oxygen content of about 80%, which is still clearly above that obtained for formulation 1c when not contaminated with copper ions.

EXAMPLE 4

This example demonstrates the primary washing power of a composition (4a) according to the invention compared with that of a phosphate-containing detergent which contains the same surface-active component (4b). The washing tests were carried out in a launderometer. The tests were carried out with a liquor ratio of 1:12.5 at 90° C. with 5 gm/l of detergent in water having a degree of hardness of 12° dH, and continued for 30 minutes, 20 minutes of which were taken up with heating up. Artificially soiled polyester/cotton or cotton fabrics which had not been finished were used as the samples. To assess the washing power, the degree of whiteness of the washed textile samples was determined in a color filter measuring instrument RFC 3 of Zeiss, Germany, using a R46 filter. The remission values obtained, which are entered in the Table below, show that the detergent according to the invention is at least equal in its primary washing power to the commercial preparation.

| | Formulation | |
|---|---|---|
| | 4 a | 4 b |
| ABS | 5.5 | 5.5 |
| OXO+7EO | 1.7 | 1.7 |
| OXO+11EO | 3.0 | 3.0 |
| Waterglass | 4.0 | 4.0 |
| Aluminosilicate R 1 | 30.0 | — |
| Sodium tripolyphosphate | — | 25.0 |
| Sodium carbonate | — | 5.0 |
| HEDP | 0.2 | — |
| EDTA | — | 0.2 |
| Perborate | 25.0 | 25.0 |
| CMC | 1.0 | 1.0 |
| Remainder: Sodium sulfate and water | | |

TABLE 3

| Formulation | % Remission: unfinished cotton, washing temperature 90° C.; concentration: 5 gm/l | % Remission: polyester/cotton fabric, washing temperature 90° C.; concentration: 5 gm/l |
|---|---|---|
| 4 a | 62.1 | 63.8 |
| 4 b | 63.1 | 58.1 |
| | Significance $LSD_{95}$ = 1.4 | Significance $LSD_{95}$ = 0.9 |

The following examples as presented in Tables 4 and 5 give various recipes of detergents according to the invention.

TABLE 4

| Detergent component | % by weight of component in detergent according to Example 5 | 6 | 7 | 8 | 9 | 10 | 11 |
|---|---|---|---|---|---|---|---|
| ABS | 5.5 | — | 4.0 | 4.0 | — | 5.5 | 5.5 |
| Alkane sulfonate | — | 6.0 | — | — | — | — | — |
| Fs-ester sulfonate | — | — | 2.0 | — | — | — | — |
| Olefin sulfonate | — | — | — | — | 5.0 | — | — |
| Coconut alcohol sulfonate | — | — | — | 2.0 | — | — | — |
| Tallow alcohol+3-EO-sulfate | — | — | — | — | — | 2.5 | — |
| TA+14 EO | 3.0 | — | — | — | 2.0 | — | — |
| OCA+10 EO | — | — | 2.5 | 1.5 | — | — | — |
| KA+12 EO | — | — | — | — | — | — | 3.5 |
| OXO+11 EO | — | 2.0 | — | — | — | 2.5 | — |
| TA+ 7 EO | — | — | — | 2.5 | 1.5 | — | — |
| OXO+ 7 EO | — | 2.0 | — | — | — | — | — |

TABLE 4-continued

| Detergent component | % by weight of component in detergent according to Example | | | | | | |
|---|---|---|---|---|---|---|---|
| | 5 | 6 | 7 | 8 | 9 | 10 | 11 |
| TA+ 5 EO | 1.5 | — | — | — | — | — | — |
| KA+ 3 EO | — | — | 1.5 | — | — | — | — |
| Soap | 3.5 | 3.0 | 2.0 | 3.5 | 3.0 | 2.5 | 3.0 |
| Foam inhibitor | — | — | 0.4 | — | — | 0.2 | — |
| Aluminosilicate R1 | 30.0 | 30.0 | 28.0 | 32.0 | 30.0 | 29.0 | 30.0 |
| Waterglass | 4.5 | 2.0 | 3.0 | 2.5 | 3.0 | 2.0 | 3.5 |
| HEDP | 0.25 | — | 0.3 | — | — | 0.55 | — |
| HBDP | — | 0.25 | — | 0.5 | — | — | — |
| ATMP | — | — | — | — | 0.25 | — | 0.4 |
| Perborate | 25.0 | 25.0 | 28.0 | 22.5 | 23.0 | 25.0 | 25.0 |
| CMC | — | 1.0 | 1.0 | 1.0 | 1.0 | 0.8 | 0.9 |
| Brightening agent | 0.25 | 0.25 | 0.2 | 0.25 | 0.22 | 0.22 | 0.22 |
| Enzyme | 0.4 | 0.4 | — | — | 0.4 | — | — |
| Remainder: Coloring and perfuming substances, sodium sulfate and water | | | | | | | |

TABLE 5

| Detergent constituent | % by weight constituent in the detergent according to Example | | | | | |
|---|---|---|---|---|---|---|
| | 12 | 13 | 14 | 15 | 16 | 17 |
| TA+14 EO | 3.0 | — | 4.5 | — | 2.0 | — |
| KA+12 EO | — | — | — | 4.0 | — | — |
| OCA+10 EO | — | — | — | — | 2.5 | 5.0 |
| OXO+11 EO | — | 2.5 | — | — | — | — |
| TA+5 EO | 3.0 | — | 3.5 | — | — | 2.0 |
| KA+3 EO | — | — | — | 3.0 | — | 1.5 |
| OCA+5 EO | — | — | — | — | 3.5 | — |
| OXO+7 EO | — | 3.5 | — | — | — | — |
| Soap | 2.5 | 3.0 | 1.0 | 1.5 | 2.0 | 1.5 |
| i-11-14-DAA | — | 1.5 | — | — | — | — |
| i-11-14-MAA | — | — | — | —1.0 | — | |
| i-11-14-DAA+1 EO | — | — | 1.2 | 1.5 | — | — |
| Coconut fatty acid monoethanolamide | 2.0 | — | — | — | — | 1.0 |
| Waterglass | 4.5 | 3.5 | 2.0 | 2.5 | 3.5 | 3.0 |
| HEDP | 0.25 | 0.25 | — | 0.1 | — | — |
| HBDP | — | — | 0.3 | — | 0.4 | — |
| ATMP | — | — | — | 0.2 | — | 0.5 |
| Perborate | 25.0 | 28.0 | 22.0 | 24.0 | 25.0 | 25.0 |
| Aluminosilicate R1 | 30.0 | 30.0 | 32.0 | 28.0 | 29.0 | 30.0 |
| CMC | 1.0 | 1.0 | 1.0 | 1.0 | 0.8 | 0.9 |
| Brightening agent | 0.25 | 0.25 | 0.20 | 0.22 | 0.25 | 0.22 |
| Enzyme | 0.4 | — | — | 0.4 | — | 0.4 |
| Remainder: Coloring and perfuming substances, sodium sulfate and water | | | | | | |

The detergent compositions of Table 4 contain the surface-active agent combination ba and the detergent compositions of Table 5 contain the surface-active agent combination bb.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A pulverulent, phosphate-free textile detergent consisting essentially of:

(a) from 25% to 35% by weight of a water-insoluble, finely-divided, synthetically-produced, crystalline alkali metal aluminosilicate containing at least some combined water and having primary particles in the size range of from 100μ to 0.01μ and a calcium binding power of from 50 to 200 mg CaO/gm of anhydrous active substance when measured at 22° C. by the Calcium Binding Power Test Method described in the specification and the formula on the anhydrous basis:

$$0.7\text{–}1.5\ Me_2O.Al_2O_3.1.3\text{–}2.4\ SiO_2$$

where Me is an alkali metal;

(b) from 5% to 17% by weight of a surface-active component selected from the group consisting of the combination (ba) consisting of:

(ba1) 1 part by weight of at least one nonionic surface-active agent which is an ethoxylated aliphatic $C_{10}$–$C_{20}$ alcohol having a degree of ethoxylation of from 2 to 20;

(ba2) 0.3 to 1.75 parts by weight of a foam inhibitor selected from the group consisting of:

(i) an alkali metal soap of $C_{12}$–$C_{22}$ fatty acids containing to an extent of more than 50% by weight, alkali metal salts of saturated $C_{18}$–$C_{22}$ fatty acids, and (ii) mixtures of said alkali metal soap with a non-surface-active foam inhibitor in proportions of soap to non-surface-active foam inhibitor within the range of from 25:1 to 2:1, and (ba3) 0.5 to 6 parts by weight of an anionic surface-active agent selected from the group consisting of anionic surface-active sulfonates, anionic surface-active sulfates and mixtures thereof, and the combination (bb) consisting of:

(bb1) 1 part by weight of at least one nonionic surface-active agent from the group comprising the ethoxylated aliphatic $C_{10}$–$C_{20}$ alcohols having a degree of ethoxylation of from 2 to 20;

(bb2) 0.05 to 0.75 parts by weight of a foam inhibiting alkali metal soap of $C_{12}$–$C_{22}$ fatty acids containing, to an extent of more than 50% by weight, alkali metal salts of saturated $C_{18}$–$C_{22}$ fatty acids, and (bb3) 0.05 to 0.3 parts by weight of a compound having the formula:

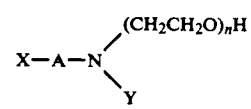

wherein X-A together represent a $C_{10}$–$C_{18}$ fatty acid acyl, X represents a β-hydroxy-$C_8$–$C_{22}$)-alkyl having the attachment in the terminal or non-terminal position, and A is a bivalent linkage selected from the group consisting of a simple C—N bond, an aminoalkylene and a polyaminopolyalkylene, which aminoalkylene or polyaminopolyalkylene may be substituted with polyethylene glycol ether groups, Y represents a member selected from the group consisting of hydrogen and the group $-(CH_2CH_2O)_m$-H, and n and m each represent a number of between 1 and 3, (c) from 0.2% to 0.6% by weight of a water-soluble organic complex former selected from the group consisting of:

(i) diphosphonates having the formula:

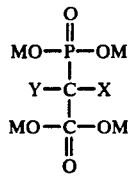

wherein X is a member selected from the group consisting of hydroxy and amino, Y is a member selected from the group consisting of alkane having from 1 to 5 carbon atoms, aminoalkane having from 2 to 5 carbon atoms, hydroxyalkane having from 2 to 5 carbon atoms, phenyl, hydroxyphenyl, aminophenyl and halophenyl, and M is a member selected from the group consisting of hydrogen and alkali metal, and (ii) aminotri-(lower alkylene phosphonic acid) and its alkali metal salts;

(d) from 15% to 30% by weight of a perborate releasing hydrogen peroxide in water, (e) 2% to 5% by weight of a sodium silicate having a ratio of $Na_2O$ to $SiO_2$ of from 1 to 3.5, and (f) from 1% to 50% by weight of other conventional ingredients for detergents of the type: soil suspension agents, optical brighteners, enzymes, antimicrobial agents, textile softeners, coloring compounds, perfumes, sodium sulfate and water.

2. The pulverulent, phosphate-free textile detergent of claim 1 wherein said calcium binding power of said aluminosilicate (a) is from 100 to 200 mg CaO/gm of anhydrous substance when measured at 22° C. by the Calcium Binding Power Test Method.

3. The pulverulent, phosphate-free textile detergent of claim 1 wherein said aluminosilicate (a) has an average particle size of below 50μ.

4. The pulverulent, phosphate-free textile detergent of claim 1 wherein said aluminosilicate (a) has an average particle size of below 40μ.

5. The pulverulent, phosphate-free textile detergent of claim 1 wherein said aluminosilicate (a) has an average particle size of from 20μ to 0.1μ.

6. The pulverulent, phosphate-free textile detergent of claim 1 wherein said aluminosilicate (a) has the formula on the anhydrous basis:

$$0.7\text{–}1.1\ Na_2O.Al_2O_3.1.3\text{–}2.4\ SiO_2$$

and a calcium binding power of from 100 to 200 mg CaO/gm of anhydrous active substance when measured at 22° C. by the Calcium Binding Power Test Method.

7. The pulverulent, phosphate-free textile detergent of claim 1 wherein said sodium aluminosilicate consists of crystallites with rounded edges and corners, the particles of which are of a size below 30μ and at least 80% of said particles are in the size range of 8μ to 0.01μ, and the maximum range of the particle size distribution curve being from 3μ to 6μ.

8. The pulverulent, phosphate-free textile detergent of claim 1 wherein said aluminosilicate (a) has the formula of the anhydrous basis:

$$0.7\text{–}1.35Na_2O.Al_2O_3.1.3\text{–}2.4SiO_2$$

and consists of a binary mixture of from 40% to 90% of particles of zeolite NaA and 10% to 60% of particles of zeolite HS.

9. The pulverulent, phosphate-free textile detergent of claim 1 wherein said surface-active component (ba) is present in an amount of from 7% to 12% by weight of said detergent.

10. The pulverulent, phosphate-free textile detergent of claim 1 wherein said component (ba2) is present in said combination (ba) in an amount of from 0.3 to 1.0 parts by weight.

11. The pulverulent, phosphate-free textile detergent of claim 1 wherein said component (ba3) is present in said combination (ba) in an amount of from 0.8 to 4 parts by weight.

12. The pulverulent, phosphate-free textile detergent of claim 1 wherein said surface-active component (bb) is present in an amount of from 7% to 12% by weight of said detergent.

13. The pulverulent, phosphate-free textile detergent of claim 1 wherein said component (bb3) is present in said combination (bb) in an amount of from 0.1 to 0.25 parts by weight.

14. The pulverulent, phosphate-free textile detergent of claim 1 wherein said anionic surface-active component (ba3) includes at least one sulfonate selected from the group consisting of alkylbenzene sulfonates, alkane sulfonates and mixtures thereof.

15. The pulverulent phosphate-free textile detergent of claim 14 wherein at least two-thirds of the weight of said anionic surface-active agents (ba3) consists of said alkylbenzene sulfonates and/or said alkane sulfonates and up to one-third of their weight consists of anionic surface-active agents selected from the group consisting of α-sulfo fatty acid esters, olefin sulfonates, fatty alcohol sulfates and fatty alcohol polyglycol ether sulfates.

16. The pulverulent, phosphate-free textile detergent of claim 1 wherein said ethoxylated aliphatic $C_{10}$–$C_{20}$ alcohol having a degree of ethoxylation of from 2 to 20 (ba1) consists of a binary mixture of separately prepared ethylene oxide addition products having average degrees of ethoxylation of from 2 to 7 and from 8 to 20 mols of ethylene oxide and the ratio of compound having a low degree of ethoxylation to the compound having a higher degree of ethoxylation is from 3:1 to 1:3.

17. The pulverulent, phosphate-free textile detergent of claim 1 wherein said ethoxylated aliphatic $C_{10}$–$C_{20}$ alcohol having a degree of ethoxylation of from 2 to 20 (bb1) consists of a binary mixture of separately prepared ethylene oxide addition products having average degrees of ethoxylation of from 2 to 7 and from 8 to 20 mols of ethylene oxide and the ratio of compound having a low degree of ethoxylation to the compound having a higher degree of ethoxylation is from 3:1 to 1:3.

18. The pulverulent, phosphate-free textile detergent of claim 1 wherein said ethoxylated $C_{10}$–$C_{20}$ aliphatic alcohol is selected from the group consisting of alkanols, alkenols and oxoalkanols.

19. The pulverulent, phosphate-free textile detergent of claim 1 wherein said surface-active compound (bb3) is the ethoxylated reaction product of 1 mol of a low molecular weight amine having from 1 to 9 carbon atoms, 1 to 4 nitrogen atoms and at least one labile hydrogen atom with 1 mol of a $C_8$–$C_{22}$ epoxyalkane.

20. The pulverulent phosphate-free textile detergent of claim 19 wherein said low molecular weight amine is selected from the group consisting of monoethanolamine, diethanolamine, ethylene diamine, diethylene triamine and triethylene tetraamine.

21. The pulverulent phosphate-free textile detergent of claim 19 wherein said epoxyalkane has from 10 to 18 carbon atoms.

22. The pulverulent, phosphate-free textile detergent of claim 1 wherein said surface-active compound (bb3) is an ethanolamide of $C_8$–$C_{18}$ fatty acids.

23. The pulverulent, phosphate-free textile detergent of claim 1 wherein said surface-active compound (bb3) is a monoethanolamide of $C_{12}$–$C_{15}$ fatty acids.

24. The pulverulent, phosphate-free textile detergent of claim 1 wherein said water-soluble organic complex former (c) is selected from the group consisting of:
1-hydroxyethane-1,1-diphosphonic acid,
1-aminoethane-1,1-diphosphonic acid,
3-amino-1-hydroxypropane-1,1-diphosphonic acid,
1-amino-1-p-chlorphenylmethane-1,
1-diphosphonic acid,
1-hydroxy-1-p-chlorphenylmethane-1,1-diphosphonic acid,
1-hydroxy-1-phenylmethane-1,1-diphosphonic acid,
1-hydroxybutane-1,1-diphosphonic acid, and
aminotri-(methylene phosphonic acid),
all in the form of an alkali metal salt thereof.

25. The pulverulent, phosphate-free textile detergent of claim 24 wherein said alkali metal salt is the sodium salt.

26. The pulverulent, phosphate-free textile detergent of claim 1 wherein said water-soluble organic complex former (c) is the sodium salt of 1-hydroxyethane-1,1-diphosphonic acid.

27. The pulverulent, phosphate-free textile detergent of claim 1 wherein said water-soluble organic complex former (c) is the sodium salt of 1-hydroxybutane-1,1-diphosphonic acid.

28. The pulverulent, phosphate-free textile detergent of claim 1 wherein said water-soluble organic complex former (c) is the sodium salt of aminotri-(methylene phosphonic acid).

29. The pulverulent, phosphate-free textile detergent of claim 1 wherein said component (d) is sodium perborate tetrahydrate.

30. In the process of washing soiled textiles comprising agitating said soiled textiles with an aqueous liquor containing a wash-effective amount of a textile detergent containing an inorganic percompound at a temperature between 75° C. and 99.5° C. for a time sufficient to separate and suspend said soil, rinsing said textile and recovering cleaned textile, the improvement consisting of using the pulverulant, phosphate-free textile detergent of claim 1, as said textile detergent containing an inorganic percompound.

31. The pulverulent, phosphate-free textile detergent of claim 1 wherein said component (b) is present in an amount of from 7% to 12% by weight of said component (d) is present in an amount of from 20% to 25% by weight.

32. The pulverulent, phosphate-free textile detergent of claim 1 containing no magnesium silicate and salts of aminopolycarboxylic acids.

* * * * *